US009004089B2

(12) United States Patent
Foote

(10) Patent No.: US 9,004,089 B2
(45) Date of Patent: Apr. 14, 2015

(54) BLOWOUT PREVENTER WITH LOCK

(76) Inventor: Dean Foote, Edmonton (CA)

( * ) Notice: Subject to any disclaimer, the term of this patent is extended or adjusted under 35 U.S.C. 154(b) by 119 days.

(21) Appl. No.: 12/853,603

(22) Filed: Aug. 10, 2010

(65) Prior Publication Data

US 2011/0030805 A1 Feb. 10, 2011

Related U.S. Application Data

(60) Provisional application No. 61/232,649, filed on Aug. 10, 2009.

(51) Int. Cl.
*F17D 3/01* (2006.01)
*E21B 33/06* (2006.01)

(52) U.S. Cl.
CPC ..... *E21B 33/062* (2013.01)

(58) Field of Classification Search
USPC ..... 251/1.1, 1.3, 266–272; 277/322–342; 137/1
See application file for complete search history.

(56) References Cited

U.S. PATENT DOCUMENTS

| | | | | | |
|---|---|---|---|---|---|
| 688,314 | A * | 12/1901 | Kemp | 431/355 |
| 1,211,585 | A * | 1/1917 | Hooper | 74/548 |
| 1,425,708 | A * | 8/1922 | Springborn | 251/268 |
| 1,709,949 | A | 4/1929 | Rasmussen | |
| 2,109,801 | A * | 3/1938 | Parker | 251/270 |
| 2,193,110 | A * | 3/1940 | Penick et al. | 277/325 |
| 2,194,256 | A * | 3/1940 | Allen | 277/325 |
| 2,931,394 | A * | 4/1960 | Hamer | 138/94.5 |
| 3,791,616 | A * | 2/1974 | Le Rouax | 251/1.3 |
| 3,871,613 | A * | 3/1975 | LeRouax | 251/1.3 |
| 3,904,212 | A * | 9/1975 | Pugh et al. | 251/1.3 |
| 4,253,638 | A * | 3/1981 | Troxell, Jr. | 251/1.3 |
| 4,290,577 | A * | 9/1981 | Olson | 251/1.3 |
| 4,638,972 | A | 1/1987 | Jones | |
| 5,044,602 | A | 9/1991 | Heinonen | |
| 5,735,502 | A * | 4/1998 | Levett et al. | 251/1.3 |
| 6,113,061 | A * | 9/2000 | Van Winkle | 251/1.3 |
| 7,044,430 | B2 * | 5/2006 | Brugman et al. | 251/1.1 |
| 7,300,033 | B1 * | 11/2007 | Whitby et al. | 251/1.3 |
| 7,331,562 | B2 * | 2/2008 | Springett | 251/1.3 |
| 2008/0265188 | A1 * | 10/2008 | Springett et al. | 251/1.3 |
| 2009/0183880 | A1 * | 7/2009 | Delbridge et al. | 166/319 |

FOREIGN PATENT DOCUMENTS

| | | |
|---|---|---|
| CA | 2 506 828 C | 7/2009 |

* cited by examiner

*Primary Examiner* — John K Fristoe, Jr.
*Assistant Examiner* — Seth W Mackay-Smith
(74) *Attorney, Agent, or Firm* — Christensen O'Connor Johnson Kindness PLLC

(57) ABSTRACT

A lock for a ram shaft of a blowout preventer has a ram shaft controlled by an actuator, the ram shaft having a ram block end and a locking end, the locking end having an internal cavity that extends along an axis of the ram shaft, and a locking pin in the internal cavity. The locking pin has a release position retracted into the internal cavity, and a locking position extending from the internal cavity. A rotational stop engages the ram shaft and prevents the ram shaft from rotating. A locking pin stop is secured relative to the actuator, the locking pin stop engaging the locking pin in the locking position to prevent axial movement of the ram shaft.

6 Claims, 7 Drawing Sheets

SECTION D–D

SECTION E–E

SECTION E–E

BLOWOUT PREVENTER WITH LOCK

FIELD

This relates to a blowout preventer with a lock for locking the rams in a closed position

BACKGROUND

A typical blowout preventer 10 is shown in FIG. 1 through 3. The blowout preventer 10 has a body 12, piston rod 14 controlled by operators 15, a central bore 16 for receiving a tubular member (not shown), and a removable pressure plate 18 that covers an access opening into the inner cavity of the body 12. The depicted blowout preventer is known as a "double gate", which has four hydraulic operators 12, two for each "gate" 14. Other configurations, not shown, include a single gate with two operators, a triple gate with six operators and so on.

Referring to FIG. 4 through 7, a typical hydraulic operator 15 for a ram type blowout preventer with a lock screw 20 is shown. FIG. 4 shows the hydraulic operator 15 in the open position with the lock screw 20 in the open position, FIG. 5 shows the hydraulic operator 15 in the partially closed position with the lock screw 20 in the open position, FIG. 6 shows the hydraulic operator 15 in the closed position with the lock screw 20 in the open position, and FIG. 7 shows the hydraulic operator 15 in the fully closed position with the lock screw 20 in the closed position.

In this description, the ram shaft and piston shaft are referred to by the generic term piston rod 14. In the depicted embodiment, the piston 22 is threaded and sealed onto the piston rod 14. When the piston 22 is assembled into position, setscrews (not shown) are generally installed to secure it in place. The setscrews are torqued to "dig" into the piston rod 14 and cause permanent deformation of the piston rod material. The end 24 of the piston rod 14 is turned to a smaller diameter to receive the ram block (not shown) and does not require a specific orientation. The piston 22 is locked into position with the setscrews and turns with the ram shaft if the ram shaft turns in any of its functions.

Referring to FIG. 6 the operator 15 is in the fully closed position and the lock screw 20 is in the open position. The lock screw 20 is threaded into the end of the bonnet 26. To lock the operator in the closed position, the lock screw 20 is rotated until it contacts the end of the piston rod 14 as shown in FIG. 7.

There are two problems associated with the type of operator system shown in FIG. 4 through 7. Firstly, the setscrews cause permanent damage to the piston rod in the threaded area for the piston attachment and positioning. Service and repair of this system can be difficult and costly if the threads are too badly damaged by the setscrews. Secondly, the lock screw is threaded into the end of the "end cover". Although there is a "cover" attached to the end of the "end cover", the threads of both the "end cover" and mating "lock screw" are subject to wear from abrasive fluid contamination. Dust, dirt and particle laden well fluids contaminate the mating threads and cause deterioration in use.

Referring now to FIG. 8 through 11, a second type of hydraulic operator 15 is depicted. FIG. 8 shows the hydraulic operator 15 in the open position with the lock screw 20 in the open position, FIG. 9 shows the hydraulic operator 15 in the partially closed position with the lock screw 20 in the open position, FIG. 10 shows the hydraulic operator 15 in the closed position with the lock screw 20 in the open position, and FIG. 11 shows the hydraulic operator 15 in the fully closed position with the lock screw 20 in the closed position.

In this type of operator 15, the threads of the lock screw 20 are contained in the hydraulic fluid assembly and fully protected from abrasive fluids. Although this system is effective in protecting the mating threads, it introduces the problem of fluid displacement within the operator 15 when the lock screw 20 is engaged or disengaged. Fluid displacement within a hydraulic chamber 28 by mechanical means can be extremely dangerous. If the lock screw has been engaged for a period of time, over night for example, and needs to be released the next morning to resume rig operations, it is most important to ensure that there is a means to allow the fluid to flow freely out of the operating chamber 28 as the lock screw is screwed in. If personnel forget to attach the hydraulic hoses to their connections, or a connection fails, blocking the free flow of fluid out of the operating chamber 28 when disengaging the lock screw 20, extreme pressures can develop within the operating chamber 28. On more than one occasion, pressures have reached magnitudes that have caused the failure of the 4 retaining bolts that attach the "threaded nut" to the "piston". The situation is hazardous because the failure of the four retaining bolts is catastrophic and releases the stored energy from the pressurized fluid instantaneously. The wrench and attachments used to turn the lock screw 20 can become projectiles when failure occurs.

SUMMARY

There is provided a lock for a ram shaft of a blowout preventer, comprising a ram shaft controlled by an actuator, the ram shaft having a ram block end and a locking end, the locking end having an internal cavity that extends along an axis of the ram shaft, and a locking pin in the internal cavity. The locking pin has a release position refracted into the internal cavity, and a locking position extending from the internal cavity. A rotational stop engages the ram shaft and prevents the ram shaft from rotating. A locking pin stop is secured relative to the actuator. The locking pin stop engages the locking pin in the locking position to prevent axial movement of the ram shaft.

According to another aspect, there is provided a blowout preventer, comprising a body having opposed ram shaft openings, and a ram shaft in an actuator connected to the body. The ram shaft has a ram block end and a locking end. The locking end has an internal cavity that extends along an axis of the ram shaft. A locking pin is in the internal cavity. The locking pin has a release position refracted within the internal threaded cavity, and a locking position extending from the internal threaded cavity. A rotational stop engages the ram shaft and prevents the ram shaft from rotating. A locking pin stop is secured relative to the body. The locking pin stop engages the locking pin in the locking position to prevent axial movement of the ram shaft.

According to another aspect, there is provided a method of locking a blowout preventer, comprising the steps of: providing a blowout preventer as described above, actuating the ram shaft into the body to a closed position; and moving the locking pin to the locking position to engage the locking pin stop.

According to further aspects, the rotational stop may be at least one of the ram block and a cover that engages protrusions from the ram shaft. The locking pin may be threaded into the internal cavity.

The present design is for a hydraulic operator that maintains its rotational orientation through all the functions of its operation while providing a unique internally contained and protected lock screw system that does not interfere with the hydraulic system.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
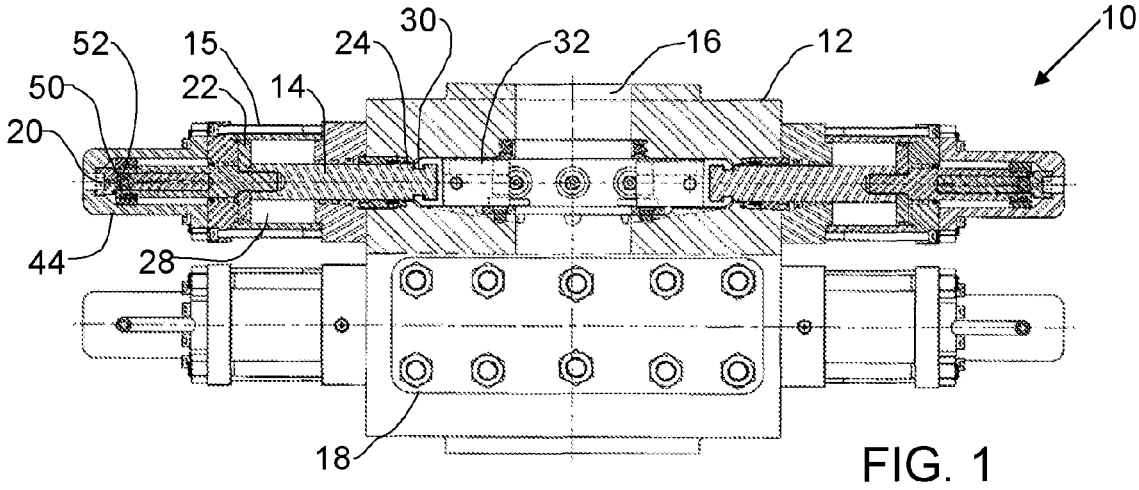
FIG. 1 is a side elevation view in partial section of a blowout preventer with the lock.
Figure 2:
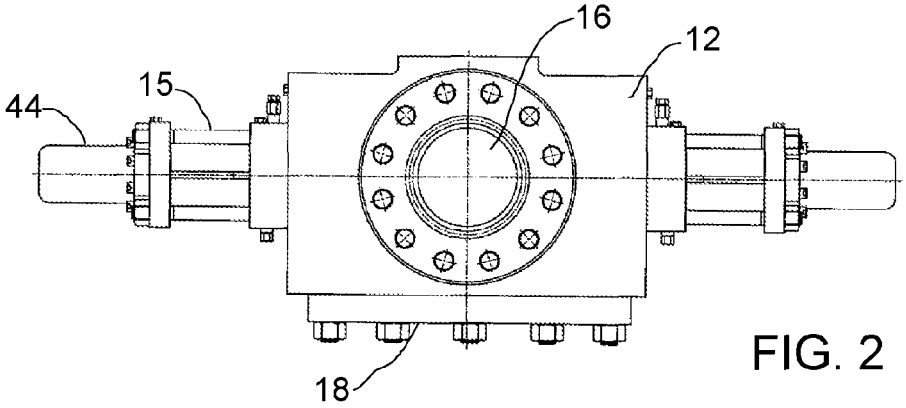
FIG. 2 is a top plan view if the blowout preventer
Figure 3:
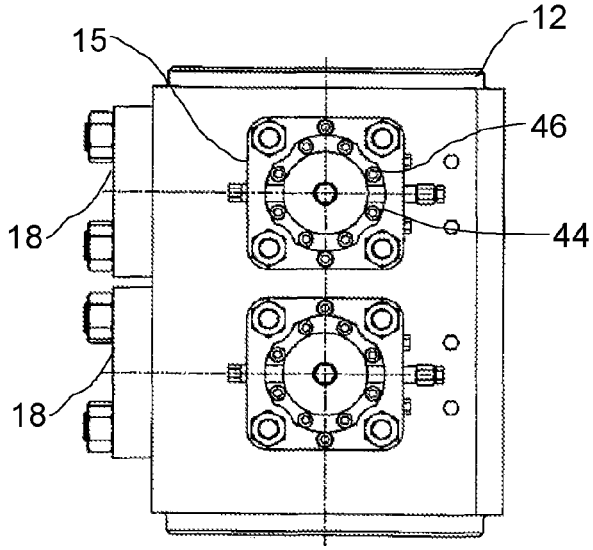
FIG. 3 is a end elevation view of the blowout preventer
Figure 4:
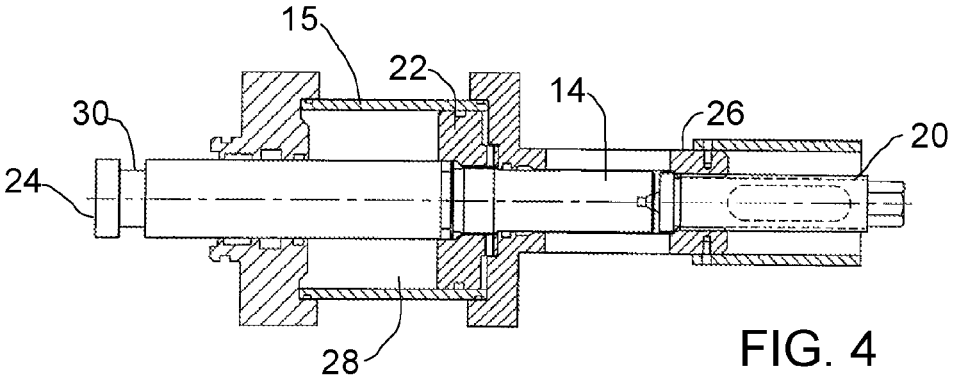
FIG. 4 PRIOR ART
FIG. 4 through 7 are side elevation views in section of a prior art locking system.
Figure 5:
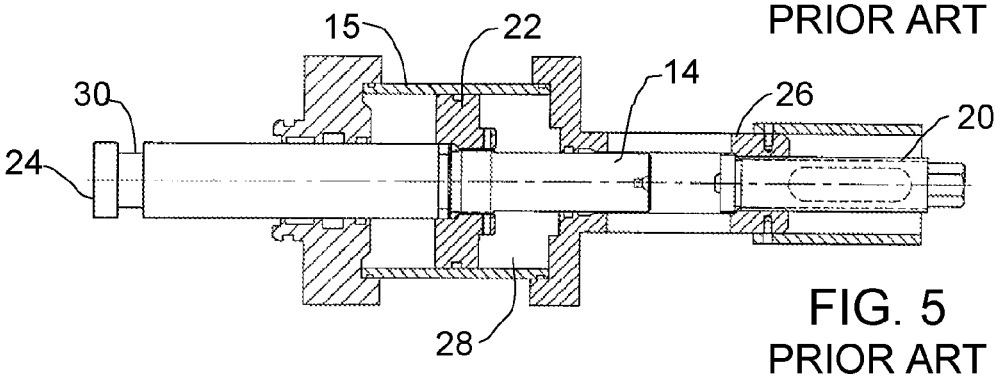
FIG. 5 PRIOR ART
Figure 6:
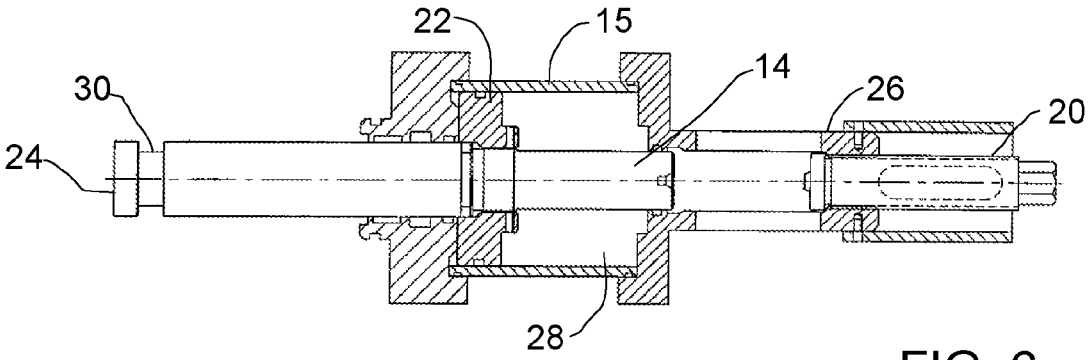
FIG. 6 PRIOR ART
Figure 7:
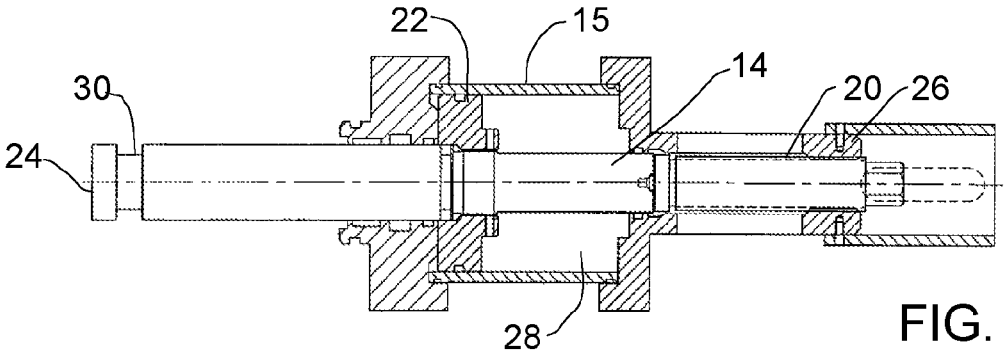
FIG. 7 PRIOR ART
Figure 8:
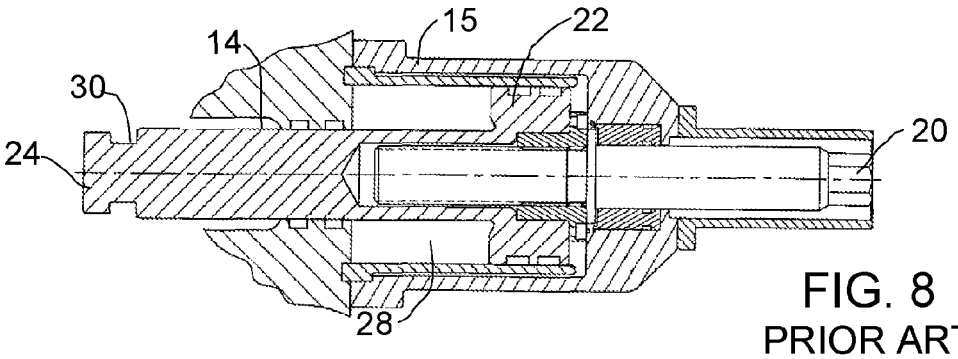
FIG. 8 PRIOR ART
FIG. 8 through 11 are side elevation views in section of an alternative prior art locking system.
Figure 9:
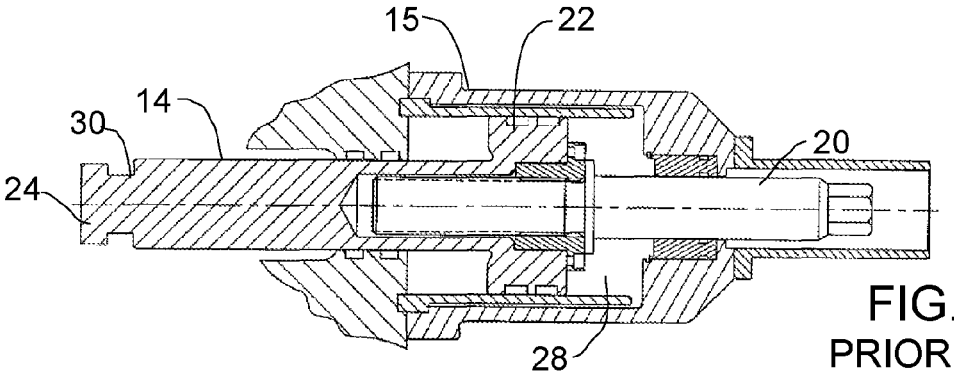
FIG. 9 PRIOR ART
Figure 10:
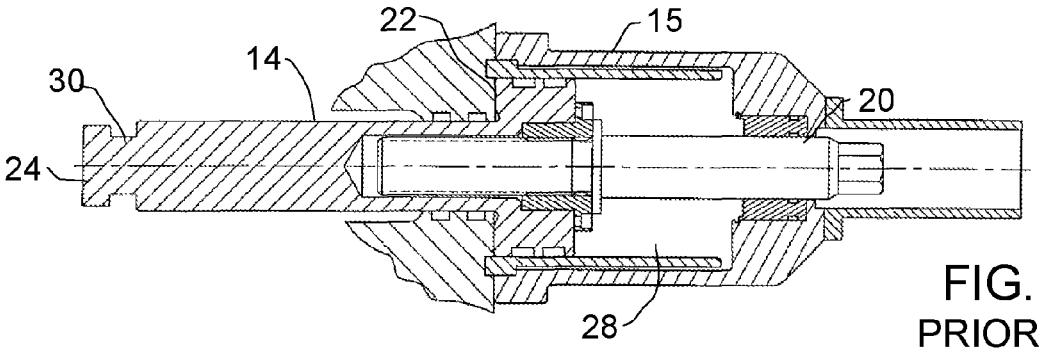
FIG. 10 PRIOR ART
Figure 11:
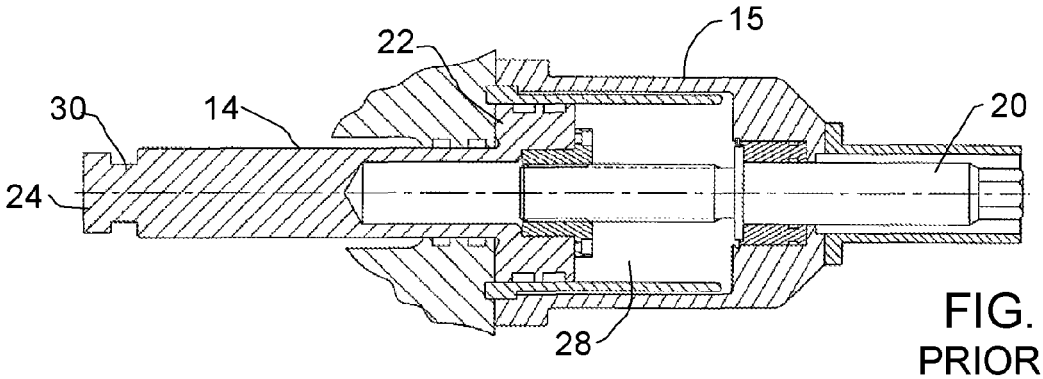
FIG. 11 PRIOR ART

A blowout preventer with lock, generally identified by reference numeral 10, will now be described with reference to FIG. 1 through 25.

Structure and Relationship of Parts:

In this description, the ram shaft and piston shaft are referred to by the generic term piston rod 14. Due to the nature of the depicted design, maintaining orientation for operation is important for two reasons. Firstly, referring to FIG. 18, the foot slot 30 that receives the ram block 32, as shown in FIG. 1, is a slotted arrangement to maximize material and strength. The use of this type of system requires that the slotted portion 30 remain in a specific alignment for the ram block 32 to slide on and off. If the slotted foot slot 20 rotates out of alignment, the ram blocks 32 may not be removed and installed easily. However, it will be understood that other cross-sections may be used, such as the example shown in FIG. 19, which has a slot that extends circumferentially. This allows for different orientations, but is not as strong. Secondly, referring to FIG. 1 the lock screw 20 is contained inside the piston shaft 14, but outside of the hydraulic operator 15. The lock screw 20 is rotated in one direction to engage and rotated in the other to disengage. To ensure the proper operation of the system, the lock screw 20 must be permitted to rotate relative to the portion of the piston shaft 14 that it is threaded into to move between the lock and release positions, and must remain stationary relative to each other to maintain those positions.

Figure 16:
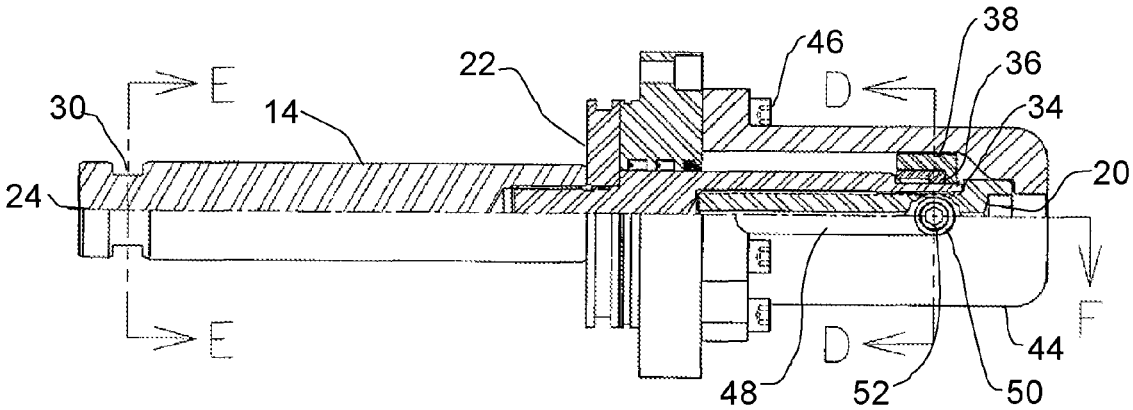
FIG. 16 is a side elevation view in section of a piston rod with the locking system.
Figure 17:
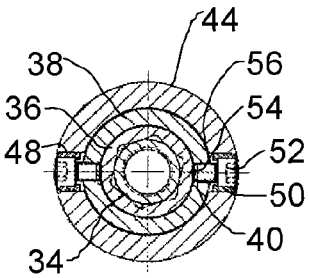
FIG. 17 is an end elevation view in section of the locking system
Figure 18:
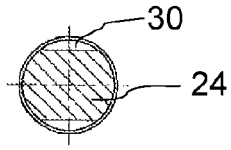
FIG. 18 is an end elevation view in section of the ram block engaging end of the piston rod.
Figure 19:
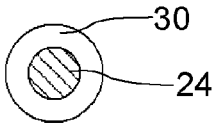
FIG. 19 is an end elevation view in section of an alternative ram block engaging end of the piston rod.

A preferred design to maintain proper orientation will now be discussed. Referring to FIGS. 16 and 17, the piston shaft 14 has a hex shape machined onto its exposed end 34. A hex collar 36 with a mating internal hex is fit over the hex on the end 34 of the piston shaft 14. A lock collar 38 is fit over top of the hex collar 36. The lock collar 38 is fitted with two threaded holes 40 opposite each other from the outside to the inside. The lock collar 38 is free to rotate on the hex collar 36. The hex collar 36 and lock collar 38 are held onto the piston shaft end 34 with a retaining ring 40. The retaining ring 40 allows the lock screw 20 to rotate, but it does not allow the hex collar 36 and lock collar 38 to move axially to disengage the hex end 34 of the piston shaft 14. The lock screw 20 is fitted with a seal washer 42 and installed in the piston shaft 14 by screwing it into the internal threads of the piston shaft 14.

Figure 22:
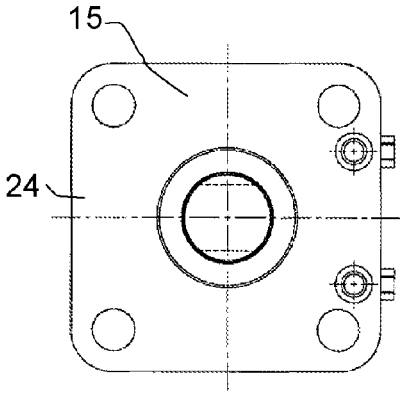
FIG. 22 is an end elevation view of the ram block engaging end of the piston rod.

An end cap 44 is fit over this assembly and bolted in place by bolts 46. The bolted arrangement does not allow the end cap 44 to rotate. Referring to FIG. 22, the end cap 44 has slots 48 machined through its sides, such as two slots 48 opposite each other as depicted, that have sufficient length to match the travel of the piston shaft 14. With the end cap 44 secured, the piston shaft 14 is rotated to the proper orientation to receive ram blocks 32, as shown in FIG. 1. The lock collar 38 inside the end cap 44 is free to rotate into position for the threaded holes 40 in the lock collar 38 to align to the two slots 48 in the end cap 44.

Figure 20:
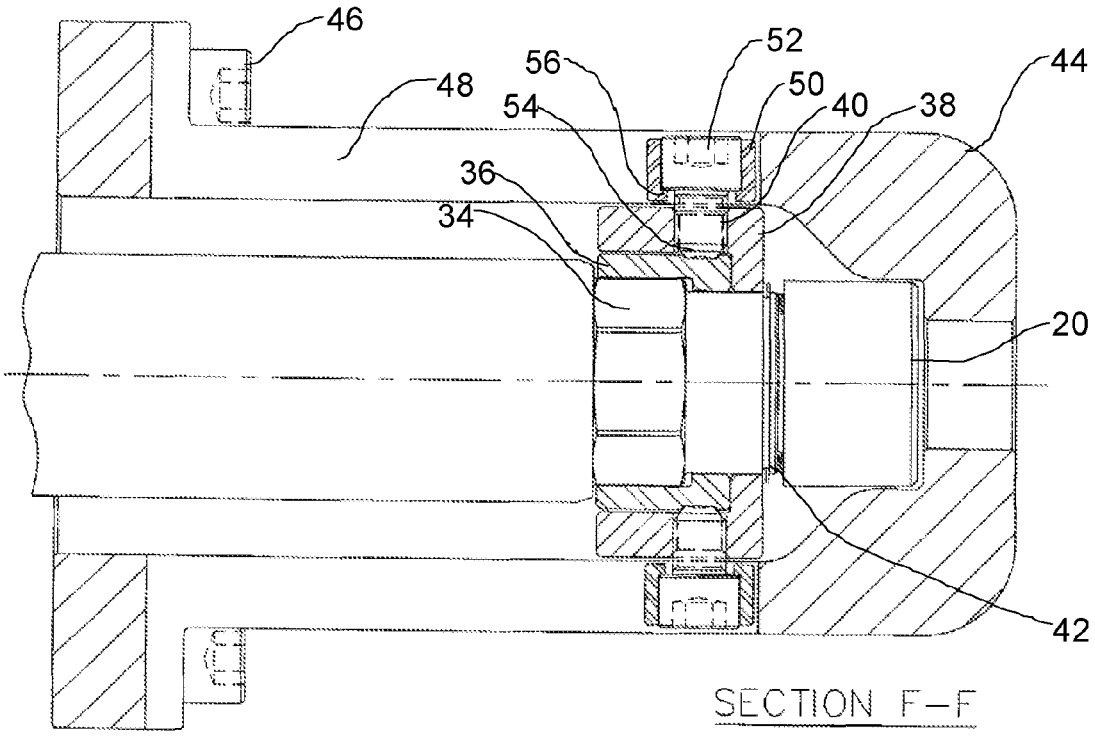
FIG. 20 is a detailed side elevation view in section of the locking system.

Referring to FIG. 20, a friction sleeve 50 is fitted to a cap screw 52 and screwed into the threaded holes 40 in the lock collar 38. The cap screw 52 is machined with a knurled cup point 54 and hardened. The friction sleeve 50 has an internal shoulder 56 that rests against the head of the cap screw 52. The cap screw 52 is torqued to dig the knurled cup point 54 into the outer surface of the hex collar 36 and permanently deform the material. When installed, the head of the cap screw 52 and the friction collar 50 are contained inside the slots 48 of the end cap 44. They are free to move axially with the movement of the piston shaft 14, but cannot rotate due to their position in the slots 48 of the end cap 44. If the cap screw 52 and friction sleeve 50 assembly contacts the sides of the slots 48, the friction sleeve 50 is free to rotate and eliminate the transfer of torque to the cap screw 52 to prevent the cap screw 52 from loosening.

Once the piston shaft 14 is thread locked, torqued, aligned and assembled with the final installation of the cap screws 52 and friction sleeves 50, it may only travel axially without rotation in the operator 15.

Figure 12:
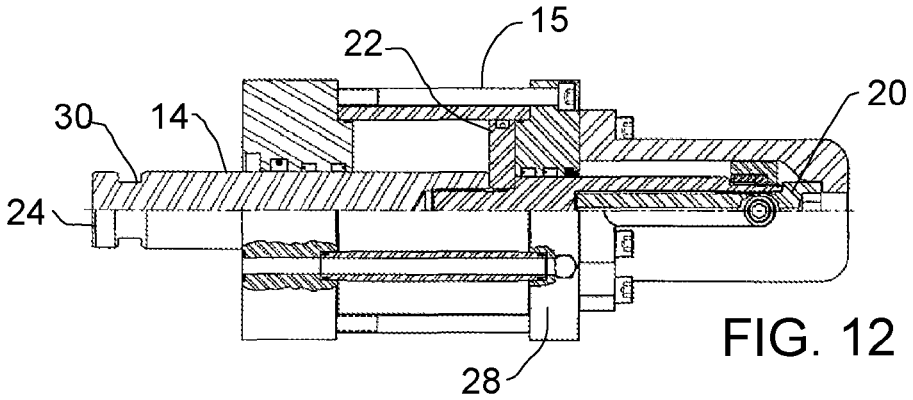
FIG. 12 through 15 are side elevation views in section of the lock depicting is operation.
Figure 13:
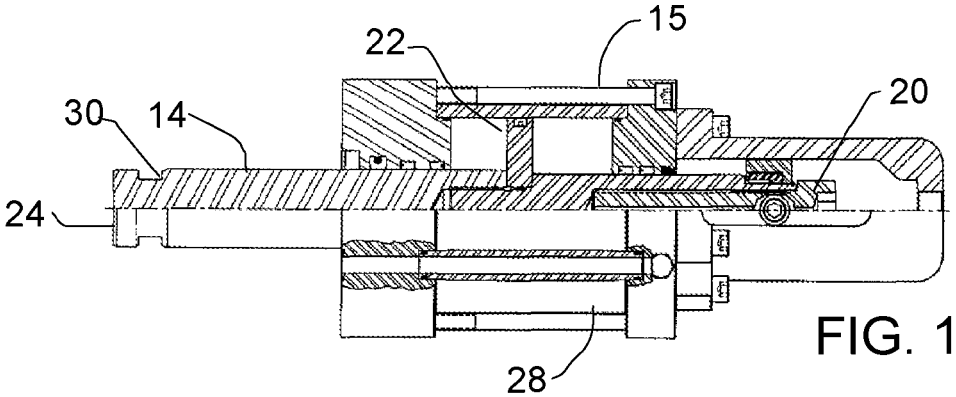
Figure 14:
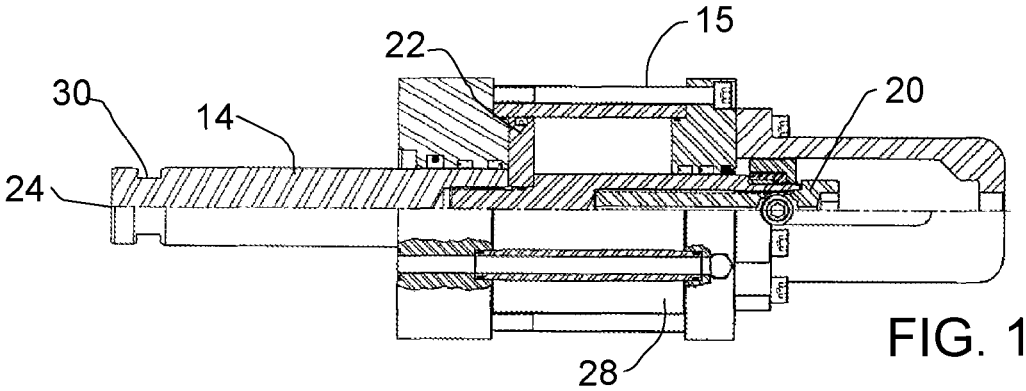
Figure 15:
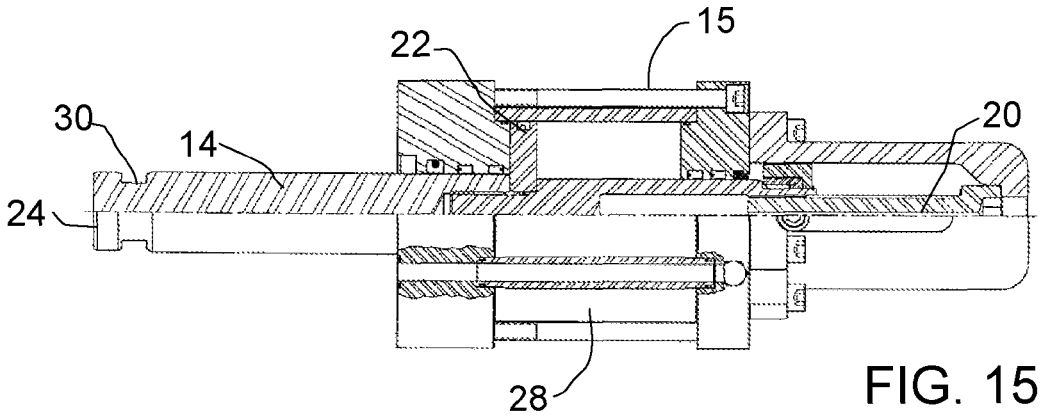
Figure 21:
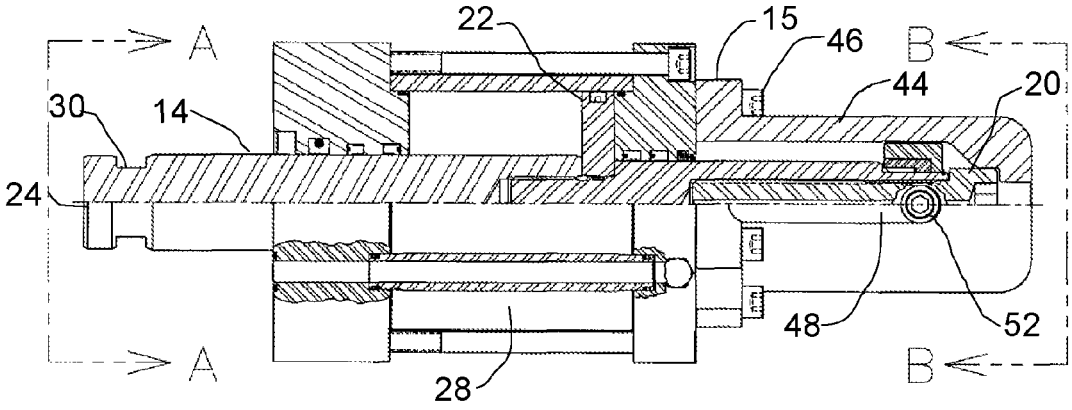
FIG. 21 is a side elevation view of the piston rod with the locking system.
Figure 23:
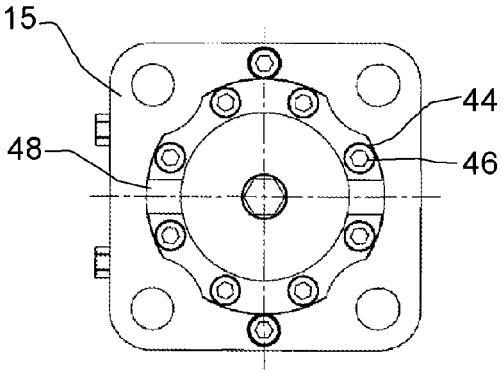
FIG. 23 is an end elevation view of the locking end of the piston rod.
Figure 24:
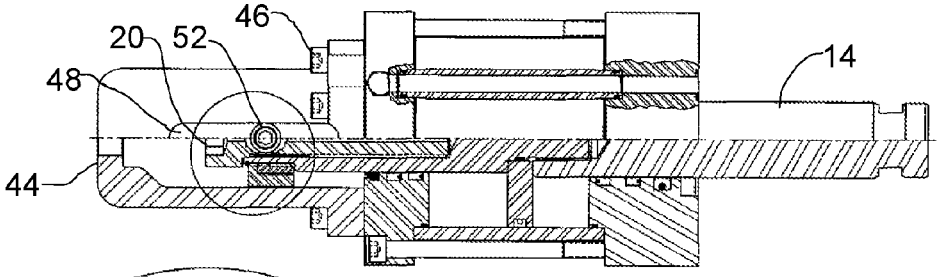
FIG. 24 is a side elevation view in partial section of the piston rod with locking system
Figure 25:
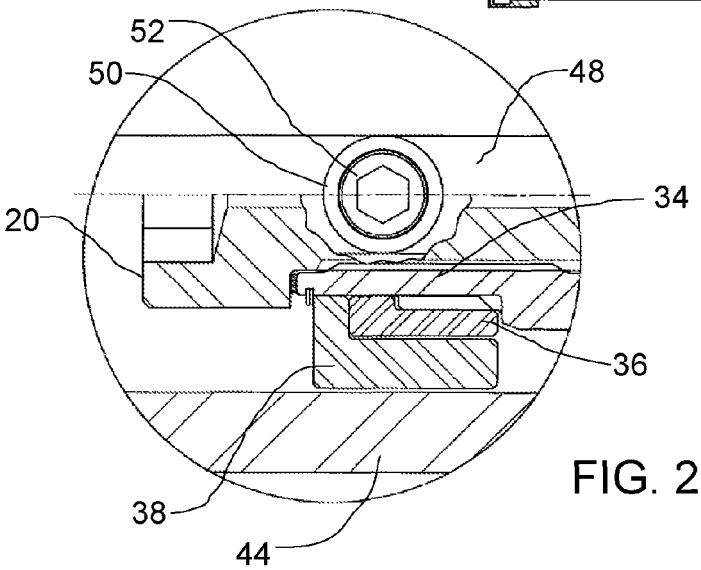
FIG. 25 is a detailed side elevation view in partial section of the engagement between the lock screw and the end cap.

FIG. 12 through 14 show the piston shaft 14 being extended from the open position in FIG. 12 to the closed position in FIG. 14. FIGS. 14 and 15 show the lock screw 20 being threaded out to lock the piston shaft 14 in the closed position. FIG. 21 shows the piston shaft 14 and operator 15 assembly in partial section, FIG. 22 shows an end view of the ram block carrying end of the assembly and FIG. 23 shows an end view of the lock screw 20 end of the assembly. FIG. 25 is a detailed view of the portion indicated in FIG. 24, showing the engagement between the lock screw 20 and the end cap 44.

The lock screw 20 may be threaded in and out of the piston shaft 14 to engage and disengage without rotating the assembly. When the lock screw 20 is disengaged, the seal washer 42 is preferably compressed between the end of the piston shaft 14 and the head of the lock screw 20. This keeps the threads between the two components clean and free from abrasive fluids and particles when not in use to reduce the wear of the parts.

In comparison with the first type of operator described in the prior art with reference to FIG. 4 through 7, the lock screw 20 presently described is contained in an economically replaceable part, namely, the piston shaft 14 as opposed to requiring the replacement of the expensive end cover, or an expensive weld procedure to repair the threads.

In comparison with the second type of prior art operator described with reference to FIG. 8 through 11, the lock screw 20 may be engaged and disengaged without affecting the hydraulic system as opposed to producing some potentially hazardous results due to pressure build up as a result of obstructing fluid flow out of the operator chamber when disengaging the lock screw 20.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A lock for a ram shaft of a blowout preventer, wherein the ram shaft is controlled by a hydraulic actuator having a hydraulic chamber enclosing a portion of the ram shaft, the ram shaft having a ram block end and a locking end, the locking end having an internal cavity that extends along an axis of the ram shaft, the ram shaft carrying a piston between the ram block and the locking end, the piston being positioned within the hydraulic chamber, the lock comprising:

a locking pin having a head and a threaded portion, the head comprising a profile that is engaged by a rotary tool to rotate the locking pin, the threaded portion being threaded into the internal cavity sealed from the hydraulic chamber, the locking pin having a release position threaded into the internal cavity, and a locking position threaded out from the internal cavity;

a rotational stop engaging the ram shaft and preventing the ram shaft from rotating; and an end cap having an inner surface comprising a locking pin stop, the end cap being secured relative to the hydraulic actuator and sealed from the hydraulic chamber, in the locking position the locking pin stop engaging the head of the locking pin to prevent axial movement of the ram, shaft the head of the locking pin being spaced within the end cap;

wherein the rotational stop comprises:

an inner collar having a cylindrical outer surface and a profiled inner surface that engages a profile on an outer surface of the ram shaft such that the inner collar is rotationally locked to the ram shaft;

a lock collar having an outer surface and a cylindrical inner surface that is sized to rotationally receive the inner collar, the lock collar having threaded apertures that extend between the outer surface and the inner surface; and lock screws threaded into the threaded apertures, the lock screws having a first end that engages and deforms the cylindrical outer surface of the inner collar to rotationally lock the lock collar in a selected rotational position to the inner collar and a second end that engages slots that extend axially along the end cap.

2. The lock of claim 1, wherein the rotational stop engages at least one of the ram block and a cover that engages protrusions from the ram shaft.

3. A blowout preventer, comprising:

a body having opposed ram shaft openings;

a ram shaft in a hydraulic actuator having a hydraulic chamber enclosing a portion of the ram shaft, the ram shaft having a ram block end and a locking end, the locking end having an internal cavity that extends along an axis of the ram shaft, the ram shaft carrying a piston between the ram block and the locking end, the piston being positioned within the hydraulic chamber;

a locking pin having a head and a threaded portion, the head comprising a profile that is engaged by a rotary tool to rotate the locking pin, the threaded portion being threaded into the internal cavity and sealed from the hydraulic chamber, the locking pin having a release position threaded into the internal threaded cavity, and a locking position threaded out from the internal threaded cavity;

a rotational stop that engages the ram shaft and prevents the ram shaft from rotating; and an end cap having an inner surface comprising a locking pin stop, the end cap being secured relative to the body and sealed from the hydraulic chamber, in the locking position the locking pin stop engaging the head of the locking pin to prevent axial movement of the ram shaft, the head of the locking pin being spaced within the end cap;

wherein the rotational stop comprises:

an inner collar having a cylindrical outer surface and a profiled inner surface that engages a profile on an outer surface of the ram shaft such that the inner collar is rotationally locked to the ram shaft;

a lock collar having an outer surface and a cylindrical inner surface that is sized to rotationally receive the inner collar, the lock collar having threaded apertures that extend between the outer surface and the inner surface; and lock screws threaded into the threaded apertures, the lock screws having a first end that engages and deforms the cylindrical outer surface of the inner collar to rotationally lock the lock collar to the inner collar and a second end that engages slots that extend axially along the end cap.

4. The blowout preventer of claim 3, wherein each ram shaft is connected to a ram block, the ram block preventing the ram shaft from rotating.

5. A method of locking a blowout preventer, comprising the steps of:

providing a blowout preventer, comprising:

a body having opposed ram shaft openings;

a ram shaft in a hydraulic actuator having a hydraulic chamber enclosing a portion of the ram shaft, the ram shaft having a ram block end and a locking end, the locking end having an internal cavity that extends along an axis of the ram shaft, the ram shaft carrying a piston between the ram block and the locking end, the piston being positioned within the hydraulic chamber;

a locking pin having a head and a threaded portion, the head comprising a profile that is engaged by a rotary tool to rotate the locking pin, the threaded portion being threaded into the internal cavity and sealed from the hydraulic chamber, the locking pin having a release position threaded into the internal threaded cavity, and a locking position threaded out from the internal threaded cavity;

a rotational stop that engages the ram shaft and prevents the ram shaft from rotating, the rotational stop comprising:

an inner collar having a cylindrical outer surface and a profiled inner surface that engages a profile on an outer surface of the ram shaft such that the inner collar is rotationally locked to the ram shaft; and a lock collar having an outer surface and a cylindrical inner surface that is sized to rotationally receive the inner collar, the lock collar having threaded apertures that extend between the outer surface and the inner surface; and an end cap having an inner surface comprising a locking pin stop, the end cap being secured relative to the body and sealed from the hydraulic chamber, in the locking position the locking pin stop engaging the head of the locking pin to prevent axial movement of the ram shaft, the head of the locking pin being spaced within the end cap; and threading lock screws into the threaded apertures of the lock collar, the lock screws having a first end that engages and deforms the cylindrical outer surface of the inner collar to rotationally lock the lock collar to the inner collar and a second end that engages slots that extend axially along the end cap;

actuating the ram shaft into the body to a closed position; and moving the locking pin to the locking position to engage the locking pin stop.

6. The method of claim 5, wherein each ram shaft is connected to a ram block, the ram block preventing the ram shaft from rotating.

* * * * *